US006199240B1

(12) United States Patent
You

(10) Patent No.: US 6,199,240 B1
(45) Date of Patent: Mar. 13, 2001

(54) INNOVATIVE STRUCTURE OF BRUSH

(76) Inventor: Bae-Jou You, No. 63, Alley 90, Lane 1, Sec. 6, Ho Mei Cheng, Chang Hua Hsien (TW)

( * ) Notice: Subject to any disclaimer, the term of this patent is extended or adjusted under 35 U.S.C. 154(b) by 0 days.

(21) Appl. No.: 09/427,634

(22) Filed: Oct. 27, 1999

(30) Foreign Application Priority Data

Nov. 9, 1998 (TW) ..... 87218779

(51) Int. Cl.[7] ..... A47L 1/06
(52) U.S. Cl. ..... 15/121; 15/220.1; 15/231
(58) Field of Search ..... 15/118, 121, 220.1, 15/220.2

(56) References Cited

U.S. PATENT DOCUMENTS 2,936,475 * 5/1960 Johns ..... 15/231
4,727,986 * 3/1988 Feldstein ..... 15/121
5,083,337 * 1/1992 Jones ..... 15/118
5,515,570 * 5/1996 Muscroft ..... 15/220.2
5,603,138 * 2/1997 Bonis ..... 15/220.1

* cited by examiner

*Primary Examiner*—Terrence R. Till
(74) *Attorney, Agent, or Firm*—Birch, Stewart, Kolasch & Birch, LLP

(57) ABSTRACT

A brush, which includes a casing having a top chamber and a bottom chamber, a sponge mounted in the top chamber in the casing, a piece of cover cloth covered on the sponge, a rectangular open frame covered on the casing around the sponge to hold down the piece of cover cloth and the sponge, two sliding locking plates respectively coupled to two sliding rails at two opposite lateral side walls of the casing and moved between a locking position where the rectangular open frame is closed, and an unlocking position where the rectangular open frame is allowed to be removed from the casing, and a wiper pivoted to the casing and turned in and out of the bottom chamber in the casing.

6 Claims, 7 Drawing Sheets

INNOVATIVE STRUCTURE OF BRUSH

BACKGROUND OF THE INVENTION

The present invention relates to an innovative structure of brush, which is equipped with a wiper for removing water from windowpanes, decks, floors, etc., and which enables the user to replace the cover cloth thereof.

A variety of brushes have been disclosed for cleaning, and have appeared on the market. Regular brushes for this purpose are commonly comprised of a handle, and hairs, bristles, wires, etc., fastened into the handle. There is known a kind of brush comprised of a casing, a sponge fastened to the casing. Because the sponge is directly rubbed against the object to be cleaned, the sponge tends to be forced away from the casing or damaged during cleaning. Further, when cleaning the house, room, etc., a wiper may be used to remove water from windowpanes, decks, floors, etc.

SUMMARY OF THE INVENTION

It is one object of the present invention to provide a sponge base brush, which uses a replaceable cover cloth to protect the sponge. It is another object of the present invention to provide a sponge base brush, which is equipped with a wiper for removing water from windowpanes, decks, floors, etc. According to one aspect of the present invention, the brush comprises a casing, the casing comprising a top receiving chamber, and two sliding rails longitudinally provided at two opposite lateral sides thereof, a sponge mounted in the top receiving chamber in the casing, a piece of cover cloth covered on the sponge, a rectangular open frame covered on the top receiving chamber of the casing around the sponge to hold down the piece of cover cloth, the rectangular open frame comprising two rows of ribs longitudinally aligned at two opposite sides thereof, and two sliding locking plates respectively coupled to the sliding rails at the casing and moved along the sliding rails to lock the rectangular open frame, the sliding locking plates each comprising a first longitudinal sliding groove coupled to one sliding rail at the casing, a second longitudinal sliding groove arranged in parallel to and spaced above the first longitudinal sliding groove for receiving one row of ribs at the rectangular open frame, and a plurality of transverse notches respectively perpendicularly extended from the second longitudinal sliding groove corresponding to the ribs at one side of the rectangular open frame for enabling the ribs of the rectangular open frame to be respectively engaged into the second longitudinal sliding groove at each of the sliding locking plates. According to another aspect of the present invention, the rectangular open frame has a substantially u-shaped cross section fitting the periphery of the top receiving chamber of the casing, enabling a part of the piece of cover cloth to be retained between an inner side wall of the rectangular open frame and the periphery of the casing. According to still another aspect of the present invention, the first sliding groove at each of the sliding locking plates has one end closed. According to still another aspect of the present invention, the sliding locking plates each comprise a locating notch, and the casing comprises two hooks at the two opposite lateral sides thereof for hooking in the locating notch at each of the sliding locking plates to limit backward movement of the sliding locking plates on the sliding rails at the casing. According to still another aspect of the present invention, the casing comprises a first coupling groove and a second coupling groove respectively disposed in the recessed bottom chamber at two opposite ends, two pairs of plug holes respectively disposed at two opposite sides of the coupling grooves in the recessed bottom chamber, a first locating member and a second locating member respectively fastened to the plug holes and disposed around the coupling grooves in the recessed bottom chamber, a wiper holder coupled between the coupling grooves in the recessed bottom chamber, a rubber blade fastened to the wiper holder and turned with the wiper holder between a vertical position where the rubber blade is disposed outside the recessed bottom chamber and a horizontal position where the rubber blade is received inside the recessed bottom chamber, the wiper holder comprising a positioning block extended from a first end thereof for engaging into the first locating member in the recessed bottom chamber to stop the wiper holder from rotary motion, a first round rod extended from the positioning block and pivoted to the first coupling groove in the recessed bottom chamber, and a second round rod extended from a second end thereof and pivoted to the second coupling groove in the recessed bottom chamber.

DETAILED DESCRIPTION OF THE PREFERRED EMBODIMENT

Figure 1:
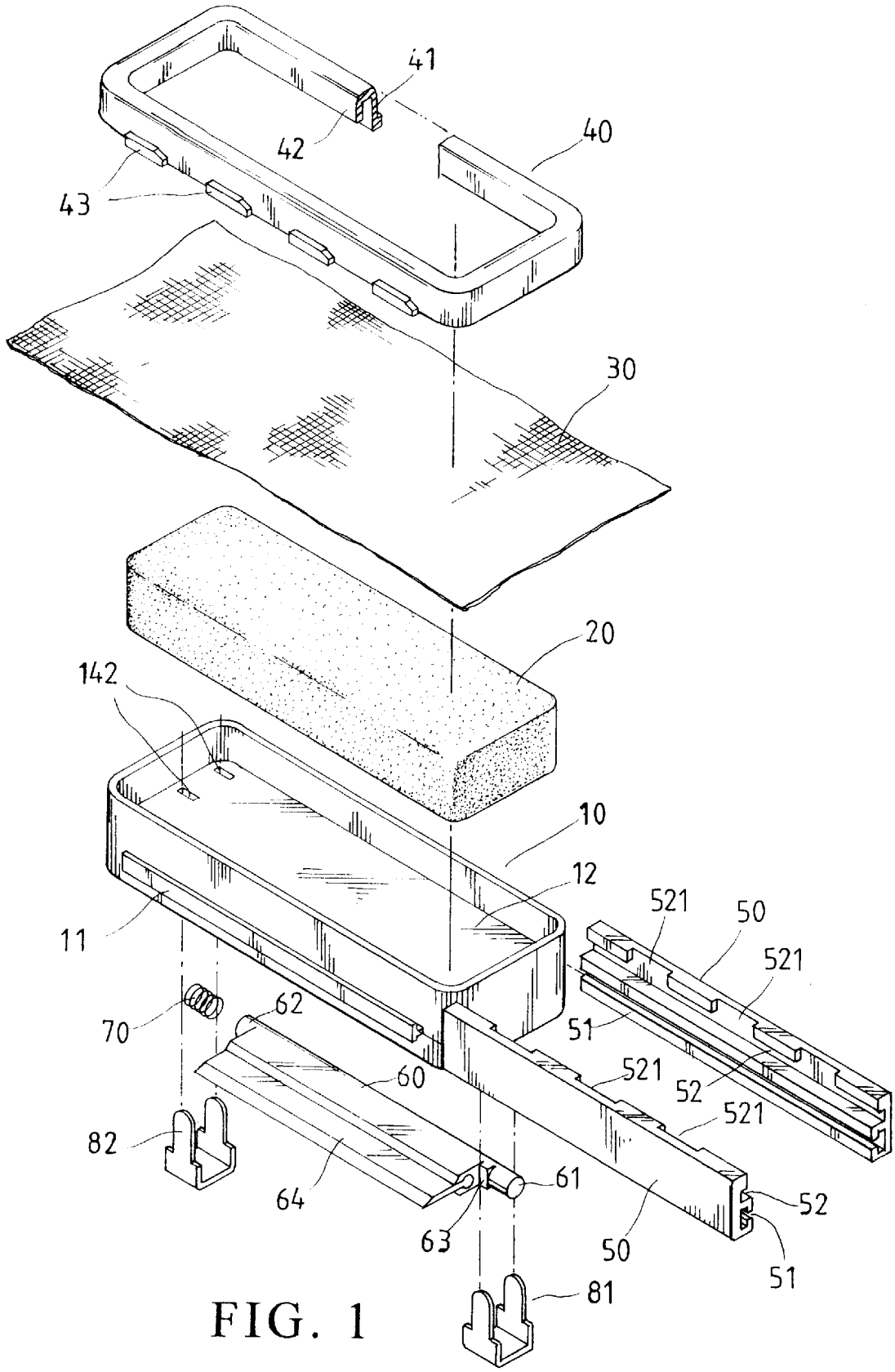
FIG. 1 is an exploded view of a brush according to the present invention.

Referring to FIGS. from 1 through 3, a brush in accordance with the present invention is generally comprised of a casing 10, a sponge 20, a piece of cover cloth 30, a locating frame 40, two sliding locking plates 50, a wiper holder 60, a compression spring 70, and two locating members 81 and 82.

The casing 10 is a lidless rectangular box comprising a receiving open chamber 12 at the topside thereof, which receives the sponge 20, and two sliding rails 11 longitudinally provided at two opposite lateral sides thereof. The locating frame 40 is a rectangular open frame of substantially u-shaped cross section fitting the top side of the casing 10, comprising an outer side wall 41, an inner side wall 42, and two rows of longitudinally aligned ribs 43 bilaterally provided at the outer side wall 42 on the outside. The two sliding locking plates 50 each comprise two longitudinal sliding grooves, namely, the first longitudinal sliding groove 51 and the second longitudinal sliding groove 52 arranged in parallel at an inner side, and a plurality of transverse notches 521 respectively extended from the second longitudinal sliding groove 52 corresponding to the ribs 43 at the locating frame 40. By coupling the first longitudinal sliding groove 51 at each sliding locking plate 50 to the sliding rails 11 at two opposite lateral sides of the casing 10, the sliding locking plate 50 are coupled to the casing 10. After having been coupled to the casing 10, the sliding locking plates 50 can be moved along the sliding rails 11 between a locking position where the locating frame 30, the piece of cover cloth 30 and the sponge 20 are secured to the casing 10, and an unlocking position where the locating frame 30, the piece of cover cloth 30 and the sponge 20 are allowed to be removed from the casing 10.

Figure 2:
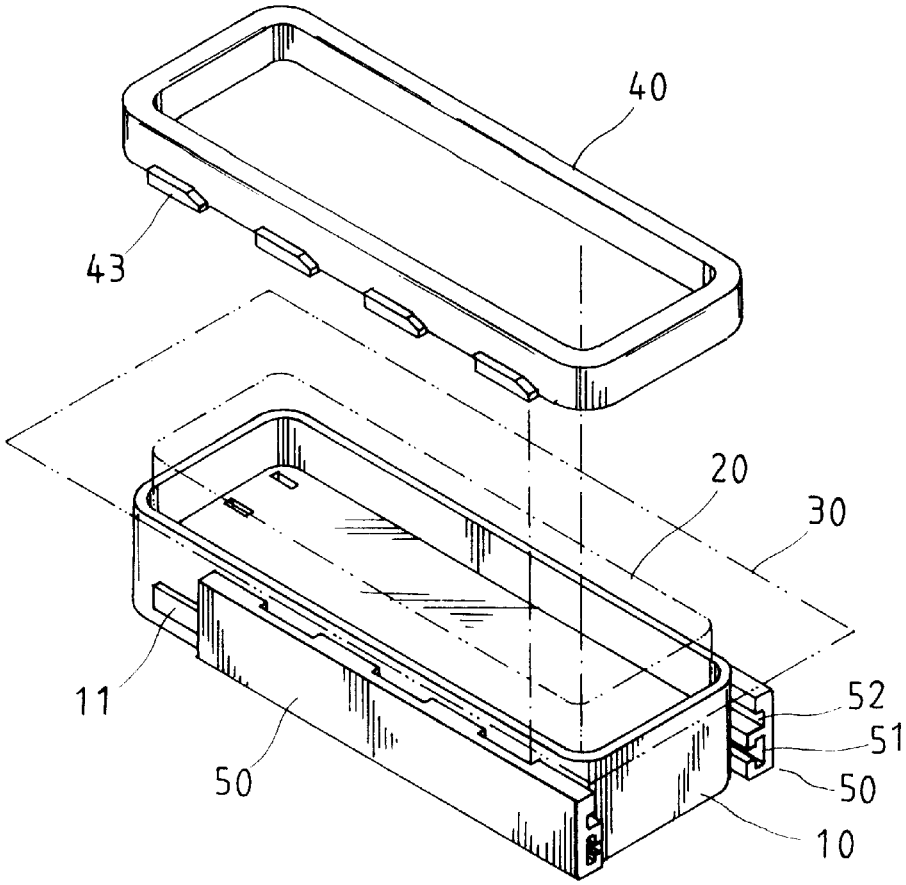
FIG. 2 is a schematic drawing explaining the assembly process of the present invention.
Figure 3:
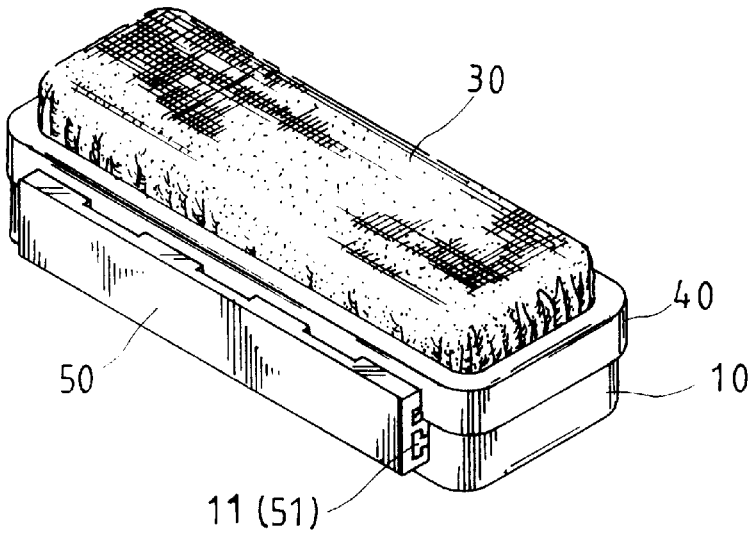
FIG. 3 is a perspective assembly view of the present invention.

Referring to FIGS. 2 and 3 again, the sliding locking plates 50 are respectively coupled to the sliding rails 11 at the casing 10 and moved to the unlocking position, and then the sponge 20 is put in the receiving open chamber 12 inside the casing 10, and then the piece of cover cloth 30 is covered on the sponge 20, and then the locating frame 40 is fastened to the top side of the casing 10 to hold down the piece of cover cloth 30 and the sponge 20, enabling a part of the piece of cover cloth 30 to be retained in between the inner side wall 42 of the locating frame 40 and the peripheral wall of the receiving open chamber 12, and then the sliding locking plates 50 are respectively moved the locking position to lock the locating frame 40. When the sliding plates 50 are moved to the unlocking position, the ribs 43 at the locating frame 40 are respectively aimed at the transverse notches 521 on the sliding locking plates 50, and therefore the locating frame 40 can be disconnected from the sliding locking plates 50. On the contrary, when the sliding plates 50 are moved to the locking position, the ribs 43 at the locating frame 40 are not in alignment with the transverse notches 521 on the sliding locking plates 50, and therefore the locating frame 40 is stopped in position.

Figure 4:
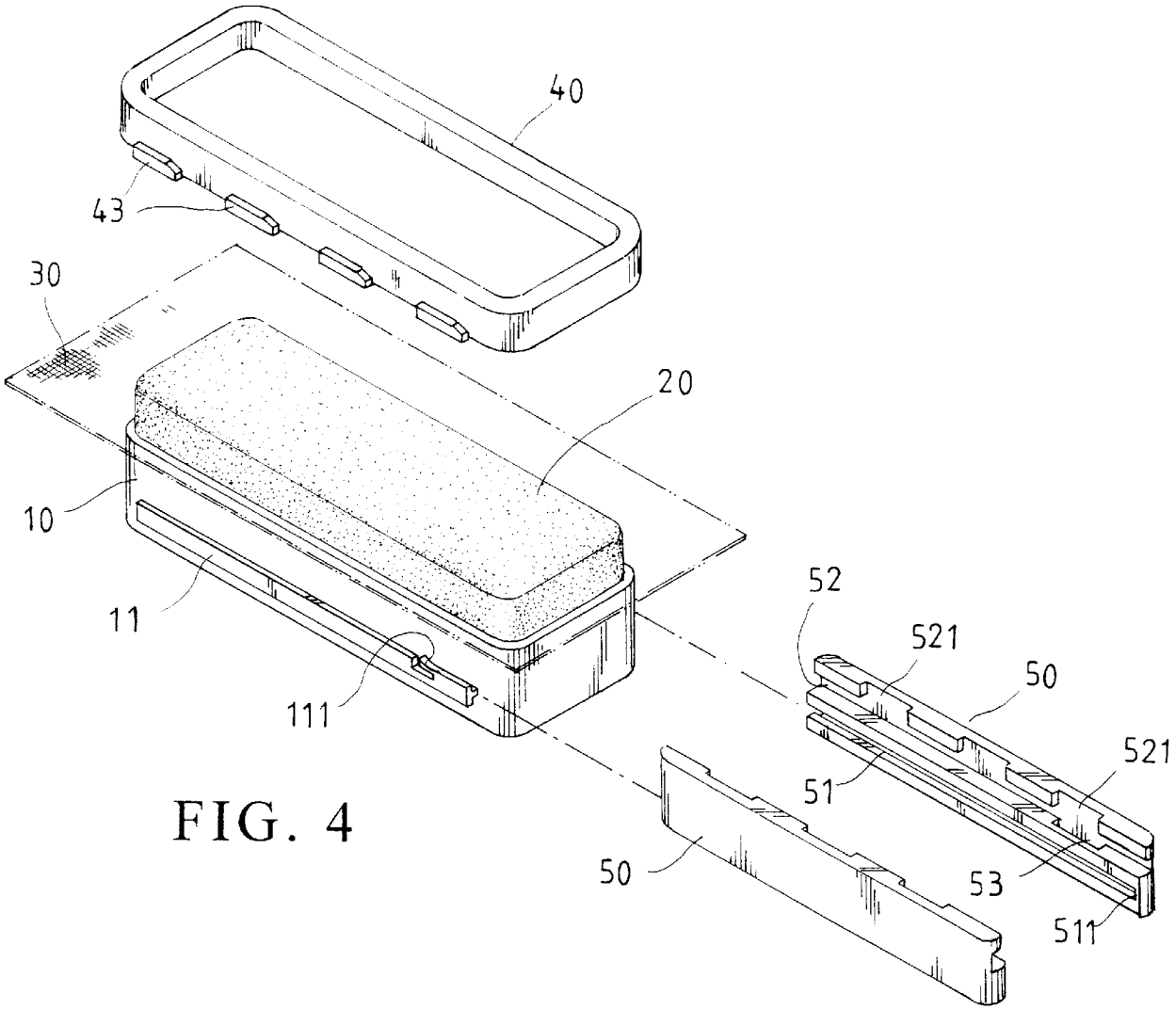
FIG. 4 is an exploded view of an alternate form of the present invention.
Figure 5:
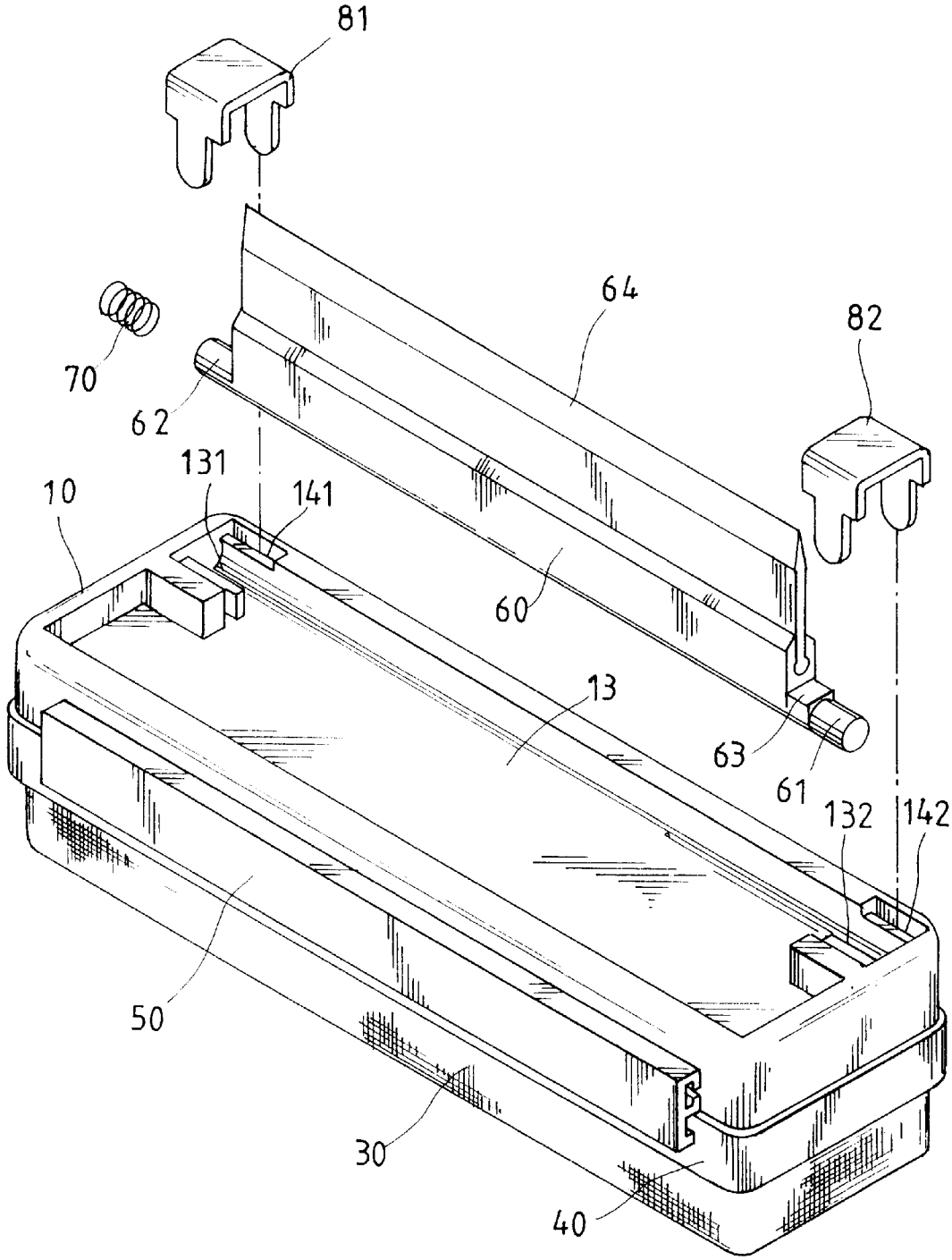
FIG. 5 is another exploded view of the present invention, showing the relative positioning of the wiper holder, the spring and the locating members on the casing.

FIG. 4 shows an alternate form of the present invention. According to this alternate form, each sliding locating plate 50 comprises a stop portion 511 at one end of the respective first longitudinal sliding groove 51, and a locating notch 53 extended from the respective first longitudinal sliding groove 51 toward the respective second longitudinal sliding groove 52. Further, the casing 10 comprises two hooks 111 respectively raised from the sliding rails 11. The stop portion 511 closes one end of the respective longitudinal sliding groove 51. When the sliding locking plates 50 are moved forwards along the sliding rails 11 at the casing 10, the stop portion 511 at each sliding locating plate 50 is respectively stopped at one end of each of the sliding rails 11, and therefore the sliding locking plates 50 are stopped in the locking position. When the sliding locking plates 50 are moved backwards from the locking position to the unlocking position, the locating notch 53 at each sliding locating plate 50 is respectively engaged with the hook 111 at each of the sliding rails 11 at the casing 10, and therefore the sliding locking plates 50 are prohibited from further backward movement.

Figure 6:
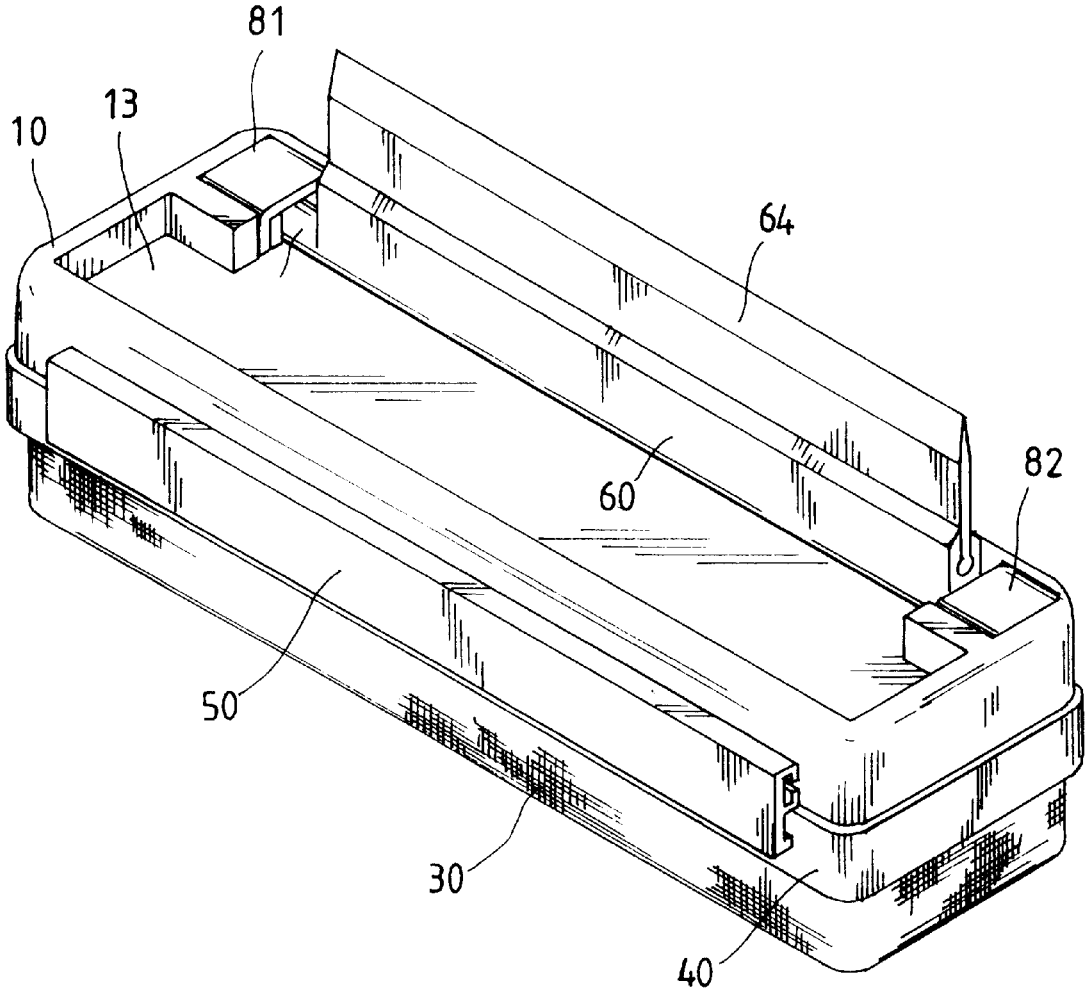
FIG. 6 is an assembly view of FIG. 5, showing the rubber blade extended out of the recessed bottom chamber in the casing.
Figure 7:
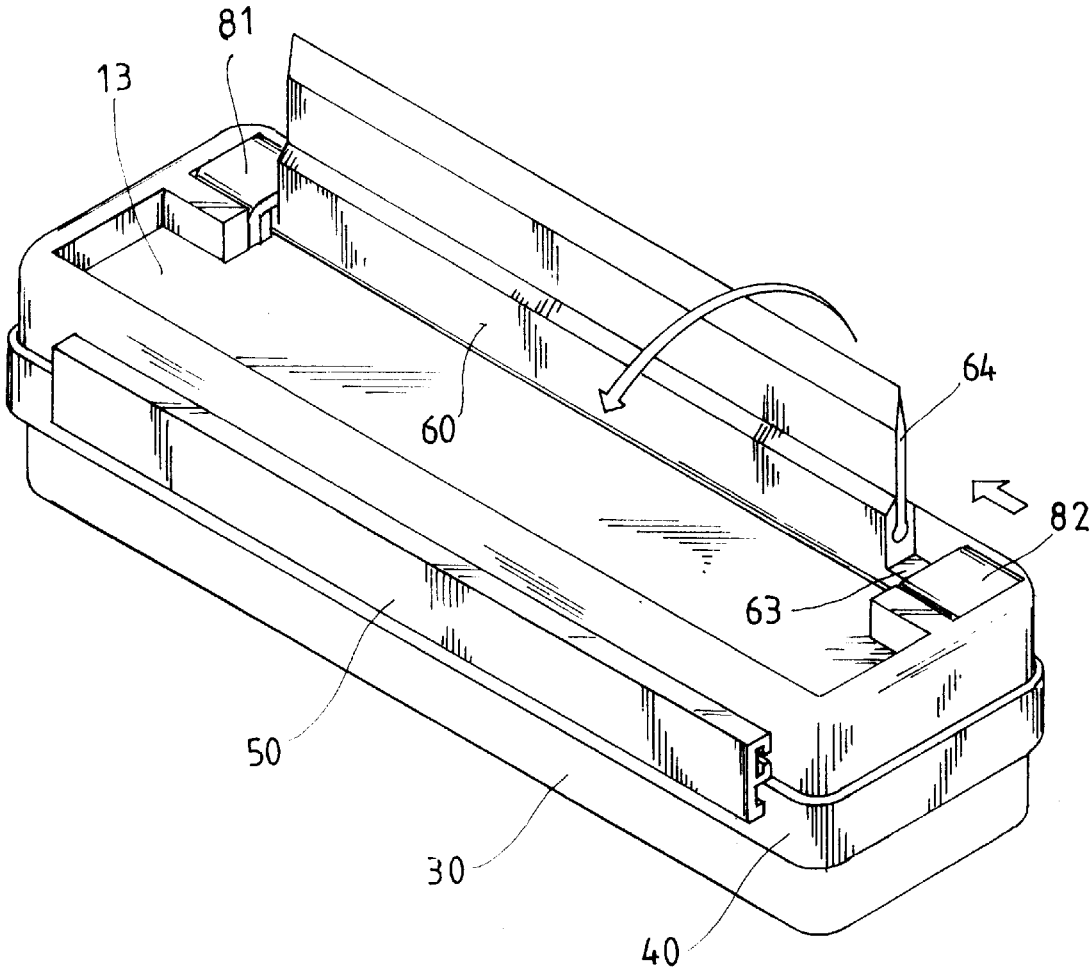
FIG. 7 shows the movement of the wiper holder relative to the casing according to the present invention.
Figure 8:
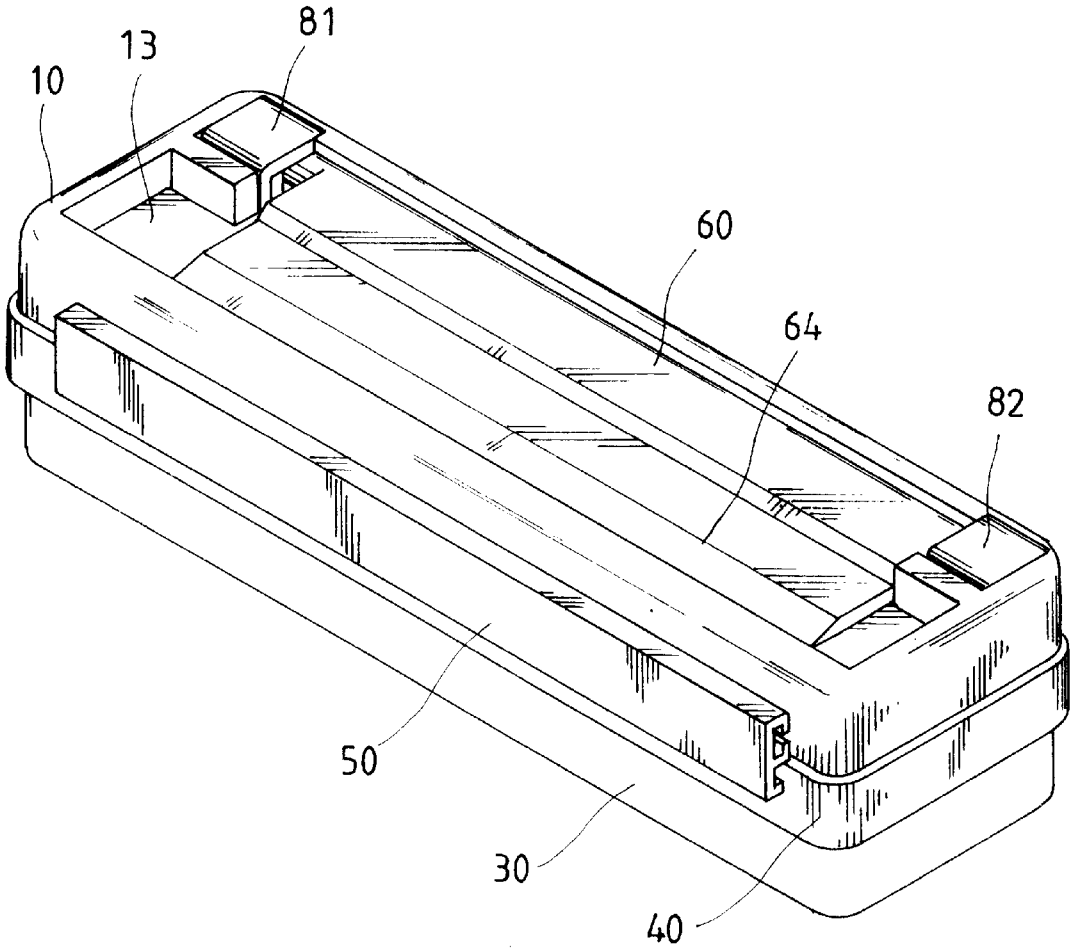
FIG. 8 is similar to FIG. 6 but showing the rubber blade received with the wiper holder in the recessed bottom chamber in the casing.

Referring to FIGS. from 5 through 8, the casing 10 comprises a recessed bottom chamber 13 at the bottom side thereof, two coupling grooves 131 and 132 disposed in the recessed bottom chamber 13 at two opposite ends, and two pairs of plug holes 141 and 142 respectively disposed at two opposite sides of the coupling grooves 131 and 132. The wiper holder 60 holds a rubber blade 64, having a positioning block 63 at one end thereof, a first round rod 61 formed integral with the positioning block 63, and a second round rod 62 extended from the other end thereof. The first round rod 61 and the second round rod 62 of the wiper holder 60 are respectively coupled to the coupling grooves 131 and 132 in the recessed bottom chamber 13 at the bottom side of the casing 10. The compression spring 70 is sleeved onto the second round rod 62, and stopped between the peripheral wall of the recessed bottom chamber 13 and one end of the wiper holder 60. The locating members 81 and 82 are respectively fastened to the plug holes 141 and 142 in the recessed bottom chamber 13 to hold the round rods 61 and 62 of the wiper holder 60 in the coupling grooves 131 and 132 in the recessed bottom chamber 13, enabling the rubber blade 41 to be turned with the wiper holder 60 between a horizontal position where the rubber blade 64 is received in the recessed bottom chamber 13 (see FIG. 8), and a vertical position where the rubber blade 64 is extended out of the recessed bottom chamber 13 (see FIG. 6).

Referring to FIGS. from 5 through 8 again, when the wiper holder 60 is pushed in one direction to compress the compression spring 70 against the peripheral wall of the recessed bottom chamber 13, the positioning block 63 is disengaged from the corresponding locating member 82, enabling the rubber blade 64 to be turned with the wiper holder 60 between the horizontal position and the vertical position. When the rubber blade 64 is turned with the wiper holder 60 to the horizontal (or vertical) position, the push force which was applied to the wiper holder 60 against the compression spring 70 is released from the wiper holder 60, enabling the positioning block 63 to be forced by the spring power of the compression spring 70 into engagement with the corresponding locating member 82 again, and therefore the wiper holder 60 is stopped from rotary motion, and positively held in the horizontal (or vertical) position.

It is to be understood that the drawings are designed for purposes of illustration only, and are not intended for use as a definition of the limits and scope of the invention disclosed.

What the invention claimed is:

1. A brush comprising:

a casing, said casing comprising a top receiving chamber, and two sliding rails longitudinally provided at two opposite lateral sides thereof;

a sponge mounted in the top-receiving chamber in said casing;

a piece of cover cloth covered on said sponge;

a rectangular open frame covered on the top receiving chamber of said casing around said sponge to hold down said piece of cover cloth, said rectangular open frame comprising two rows of ribs longitudinally aligned at two opposite sides thereof; and two sliding locking plates respectively coupled to the sliding rails at said casing and moved along said sliding rails to lock said rectangular open frame, said sliding locking plates each comprising a first longitudinal sliding groove coupled to one sliding rail at said casing, a second longitudinal sliding groove arranged in parallel to and spaced above said first longitudinal sliding groove for receiving one row of ribs at said rectangular open frame, and a plurality of transverse notches respectively perpendicularly extended from said second longitudinal sliding groove corresponding to the ribs at one side of said rectangular open frame for enabling the ribs at said rectangular open frame to be respectively engaged into the second longitudinal sliding groove at each of said sliding locking plates.

2. The brush of claim 1 wherein said rectangular open frame has a substantially u-shaped cross section fitting the periphery of the top receiving chamber of said casing, enabling a part of said piece of cover cloth to be retained between an inner side wall of said rectangular open frame and the periphery of said casing.

3. The brush of claim 1 wherein the first sliding groove at each of said sliding locking plates has one end closed.

4. The brush of claim 1 wherein said sliding locking plates each comprise a locating notch, and said casing comprises two hooks at the two opposite lateral sides thereof for hooking in the locating notch at each of said sliding locking plates to limit backward movement of said sliding locking plates on the sliding rails at said casing.

5. The brush of claim 4 wherein said locating notch extends from the first longitudinal sliding groove at the respective sliding locking plate toward the respective second longitudinal sliding groove, and the hooks at said casing are respectively raised from said sliding rails.

6. The brush of claim 1 wherein said casing comprises a recessed bottom chamber, a first coupling groove and a second coupling groove respectively disposed in said recessed bottom chamber at two opposite ends, two pairs of plug holes respectively disposed at two opposite sides of the coupling grooves in said recessed bottom chamber, a first locating member and a second locating member respectively fastened to said plug holes and disposed around the coupling grooves in said recessed bottom chamber, a wiper holder coupled between the coupling grooves in said recessed bottom chamber, a rubber blade fastened to said wiper holder and turned with said wiper holder between a vertical position where said rubber blade is disposed outside said recessed bottom chamber and a horizontal position where said rubber blade is received inside said recessed bottom chamber, said wiper holder comprising a positioning block extended from a first end thereof for engaging into the first locating member in said recessed bottom chamber to stop said wiper holder from rotary motion, a first round rod extended from said positioning block and pivoted to the first coupling groove in said recessed bottom chamber, and a second round rod extended from a second end thereof and pivoted to the second coupling groove in said recessed bottom chamber.

* * * * *